US009021811B2

(12) United States Patent
Lam

(10) Patent No.: US 9,021,811 B2
(45) Date of Patent: May 5, 2015

(54) GAS TURBINE SWIRLER INCLUDING A VORTEX GENERATOR DEVICE AND FUEL INJECTION OPENINGS ARRANGED BETWEEN ADJACENT VANES

(75) Inventor: Kam-Kei Lam, Bracebridge Heath (GB)

(73) Assignee: Siemens Aktiengesellschaft, München (DE)

( * ) Notice: Subject to any disclaimer, the term of this patent is extended or adjusted under 35 U.S.C. 154(b) by 638 days.

(21) Appl. No.: 13/266,297

(22) PCT Filed: May 5, 2009

(86) PCT No.: PCT/EP2009/003216

§ 371 (c)(1),
(2), (4) Date: Oct. 26, 2011

(87) PCT Pub. No.: WO2010/127682

PCT Pub. Date: Nov. 11, 2010

(65) Prior Publication Data

US 2012/0042655 A1 Feb. 23, 2012

(51) Int. Cl.

| | |
|---|---|
| ***F02C 1/00*** | (2006.01) |
| ***F02G 3/00*** | (2006.01) |
| ***F23R 3/14*** | (2006.01) |
| ***F23C 7/00*** | (2006.01) |
| ***F23R 3/28*** | (2006.01) |

(52) U.S. Cl.
CPC . *F23R 3/14* (2013.01); *F23C 7/004* (2013.01); *F23R 3/286* (2013.01)

(58) Field of Classification Search
CPC ..... F23R 3/14; F23R 3/286; F23C 7/004
USPC ..... 60/748, 737, 740; 239/399, 400, 402, 239/403
See application file for complete search history.

(56) References Cited

U.S. PATENT DOCUMENTS

| | | | | |
|---|---|---|---|---|
| 5,408,830 | A * | 4/1995 | Lovett | 60/737 |
| 5,947,081 | A | 9/1999 | Kim | |
| 6,237,344 | B1 * | 5/2001 | Lee | 60/754 |
| 2009/0111063 | A1 * | 4/2009 | Boardman et al. | 431/8 |

FOREIGN PATENT DOCUMENTS

| | | | |
|---|---|---|---|
| CN | 101220955 | A | 7/2008 |
| CN | 101375101 | A | 2/2009 |
| EP | 1867925 | A1 | 12/2007 |
| EP | 1916481 | A2 | 4/2008 |
| EP | 1921378 | A2 | 5/2008 |
| EP | 2169304 | A1 | 3/2010 |
| GB | 2435508 | A | 8/2007 |
| GB | 2437977 | A | 11/2007 |
| RU | 2062405 | C1 | 6/1996 |
| RU | 2157954 | C2 | 10/2000 |

* cited by examiner

*Primary Examiner* — William H Rodriguez

(57) ABSTRACT

A swirler for mixing fuel and air is provided. The swirler includes a plurality of vanes positioned radially around a central axis of the swirler and a plurality of mixing channels for mixing the fuel and the air. At least one mixing channel of the plurality of mixing channels is defined by opposite walls of two adjacent vanes of the plurality of vanes and is comprising at least one fuel injection opening and is further comprising at least one dimple for generating a vortex of the air. Further, a combustion chamber incorporating such a swirler and a gas turbine incorporating such a combustion chamber are provided.

19 Claims, 7 Drawing Sheets

GAS TURBINE SWIRLER INCLUDING A VORTEX GENERATOR DEVICE AND FUEL INJECTION OPENINGS ARRANGED BETWEEN ADJACENT VANES

CROSS REFERENCE TO RELATED APPLICATIONS

This application is the US National Stage of International Application No. PCT/EP2009/003216, filed May 5, 2009 and claims priority thereof, which is incorporated by reference herein in its entirety.

FIELD OF THE INVENTION

The invention relates to a swirler, particularly of a gas turbine, and improvements for the further diminishment of air pollutants such as nitrogen oxides ($NO_X$).

BACKGROUND OF THE INVENTION

In a gas turbine burner a fuel is burned to produce hot pressurised exhaust gases which are then fed to a turbine stage where they, while expanding and cooling, transfer momentum to turbine blades thereby imposing a rotational movement on a turbine rotor. Mechanical power of the turbine rotor can then be used to drive a generator for producing electrical power or to drive a machine. However, burning the fuel leads to a number of undesired pollutants in the exhaust gas which can cause damage to the environment. Therefore, it takes considerable effort to keep the pollutants as low as possible. One kind of pollutant is nitrogen oxide ($NO_X$). The rate of formation of nitrogen oxide depends exponentially on the temperature of the combustion flame. It is therefore attempted to reduce the temperature over the combustion flame in order to keep the formation of nitrogen oxide as low as possible.

There are two main measures by which reduction of the temperature of the combustion flame is achievable. The first is to use a lean stoichiometry with a fine distribution of fuel in the air, generating a fuel/air mixture with a low fuel fraction. The relatively small fraction of fuel leads to a combustion flame with a low temperature. The second measure is to provide a thorough mixing of fuel and air before the combustion takes place. The better the mixing, the more uniformly distributed the fuel is in the combustion zone and the fewer regions exist where the fuel concentration is significantly higher than average. This helps to prevent hotspots in the combustion zone which would arise from local maxima in the fuel/air mixing ratio. With a high local fuel/air concentration the temperature will rise in that local area and so does as a result also the $NO_X$ in the exhaust.

Modern gas turbine engines therefore may use the concept of premixing air and fuel in lean stoichiometry before combustion of this fuel/air mixture. Pre-mixing may take place by injecting fuel into an air stream in a swirling zone of a combustor which is located upstream from the combustion zone. The swirling leads to a mixing of fuel and air before the mixture enters the combustion zone. Even though, due to the premixing of air and fuel, the mixing is generally good, it may occur that in operation at specific loads of the gas turbines the mixing of fuel and air may not be totally perfect.

With respect to the mentioned state of the art it is an object of the invention to provide a swirler, in particular a swirler in a gas turbine combustion chamber, a combustion chamber equipped with such a swirler, and a gas turbine having a plurality of such combustion chambers, so that mixing fuel and air in a swirling area is improved by providing a homogenous fuel/air mixture, especially at all possible loads of the gas turbine.

SUMMARY OF THE INVENTION

This objective is achieved by the independent claims. The dependent claims describe advantageous developments and modifications of the invention.

In accordance with the invention there is provided a swirler for mixing fuel and air comprising a plurality of vanes positioned radially around a central axis of the swirler and comprising a plurality of mixing channels for mixing the fuel and the air. At least one mixing channel of the plurality of mixing channels is defined by opposite walls of two adjacent vanes of the plurality of vanes and is comprising at least one fuel injection opening and further comprising at least one dimple for generating a vortex of the air.

Furthermore the invention is also directed at components comprising such a swirler, particularly a combustion chamber of a gas turbine. Besides, the invention is also directed to a gas turbine comprising at last one of such a combustion chamber.

The inventive swirler is advantageous because the dimple provides an extra turbulence, and/or enhances turbulent intensity, and/or provides swirl, and/or generates vortex structure. As a consequence the fuel to air mixture may be more homogenous. As a further consequence and advantage, $NO_X$ emissions are reduced.

Advantageously, the dimple may be arranged to provide a mixing channel individual turbulence for the respective mixing channel.

The swirler is advantageously a radial type swirler. In this case the mixing channels may be substantially perpendicular to the central axis. The mixing channels are air channels through which air is fed and in which main fuel is added. The fuel may be liquid and/or gaseous.

A dimple according to the invention is a component with the only goal to create turbulence. It has to be noted that in a gas turbine there may be gaps between components, holes for cooling, flanges, etc. which all could also lead to turbulences. But all of these mentioned items do not have the primary goal to create turbulence and therefore are not considered to be dimples according to the invention.

The term opposite or opposing in respect of the walls may not be seen as a limitation regarding the form or orientation of the walls. The opposite walls may be flat but may also be curved or of any shape. Furthermore the opposite walls may be completely identical in form but may also be different. The walls may be substantially perpendicular to a base plate of the swirler but may also have a different orientation. Thus the mixing channel may be straight or curved, a cross section defined by the walls and the base plate may be rectangular or of any other shape and may differ depending at what position the cross section will be taken.

In a preferred embodiment, the dimple—a single one or a plurality of them—may be arranged in the at least one mixing channel preferably upstream of the fuel injection opening in reference to a flow direction of the air which is passing through the mixing channel. This allows that the fuel injected via the fuel injection opening is entrained into the generated vortex structure, generated by the dimple, which leads to an enhanced premix with the air as a first positive effect. As a second positive effect, the dimple enhances the turbulence intensity of the air flow which promotes fuel and air mixing when the air passes through the dimple. This again leads to a better quality of mixing of fuel and air. And because of both effects $NO_X$ emissions will be reduced.

Additionally or alternatively, the dimple—a single one or a plurality of them—may be arranged downstream of the fuel injection opening in reference to the flow direction of the air.

Besides, additionally or alternatively to the previous options, the dimple—a single one or a plurality of them—may be located between the fuel injection opening and one of the opposite walls, preferably the dimple may be in line with the fuel injection. opening such that this fictitious line is perpendicular to the flow direction of the air.

In a further preferred embodiment the dimple may be arranged in the at least one mixing channel in a base plate of the swirler on which the plurality of vanes are mounted. Alternatively the dimple may be arranged in one or both of the opposite walls. Besides, a mixing channel may be surrounded by four walls, the already mentioned two opposite walls of two adjacent walls, the already mentioned base plate, and a further top plate which may be part of the swirler or of a further component of the combustion chamber. The dimple or a plurality of dimples may be arranged on any of these walls. In case that more than one dimple is present in the mixing channel, all kind of combinations are possible, e.g. several dimples in the base plate and/or several dimples in one or both of the opposite walls and/or several dimples in the top plate. The location of the dimples may be symmetric or asymmetric in relation to a given axis or point of symmetry.

Specifically in case of a plurality of dimples, the plurality of the at least one dimple may be arranged within the mixing channel—in the base plate or in the walls—uniformly in at least one row and at least one column in an inline or alternatively in a staggered pattern.

The form the dimple—a three-dimensionally form of the resulting cavity of the dimple and/or the shape of the outline of the dimple on a surface of the mixing channel, i.e. the rim of the dimple—may be symmetrical. Also if several dimples are in the mixing channel, the location or the form of the dimples may be e.g. axial symmetric to the main flow path of the air. As a preferred embodiment the dimple—i.e. its cavity—may be formed substantially hemispherically into the body of the surrounding surface.

As a further preferred embodiment, the dimple may have an outline in form of an ellipse, in particular a circle, or any polygon, in particular possibly a triangle. Specifically the outline may be in form of a star or a rectangle, particularly square.

In a further preferred embodiment, the dimple or specifically the outline of the dimple may be elongated perpendicular to a flow direction of the air—a local flow direction of the air at a specific spot within the mixing channel or an overall flow direction within the mixing channel. As an example, a rectangular dimple may be arranged in the mixing channel, such that the two longer side line will be perpendicular to the flow direction of the air passing through the mixing channel. The shorter side line will be parallel to the flow direction of the air. In case of an ellipse, the longest diameter of the ellipse—also called the major axis of the ellipse—may be perpendicular to the flow direction of the air. Dimples with a different elongated form will be aligned accordingly.

This may enable a maximum interaction with the air flow for vortex generation with the consequence that fuel and air mixing is promoted. Especially in locations close to the air inlet of the mixing channel, the flow direction of the air may not be totally parallel, so that a number of dimples may, for example, be arranged on a curved fictitious base line or the dimples may be curved itself. These dimples may be arranged with its elongation perpendicular to the local velocity of the air stream.

As already indicated, in a preferred embodiment the dimple and the fuel injection opening may be arranged such that the fuel injected via the fuel injection opening is injected directly into the vortex. This may improve the mixing of air and fuel.

All previously explained configurations may apply to combustion chambers with gaseous or liquid fuel operation, or with dual fuel combustion chambers. Thus, a first one of the at least one fuel injection opening may be arranged to inject liquid fuel and/or a second one of the at least one fuel injection opening may be arranged to inject gaseous fuel. These fuel injection openings may be used as main fuel supply for the combustion chamber. If additionally pilot fuel should be injected, the swirler or a burner-head may comprise a plurality of supplementary fuel injection openings additionally to the main fuel injection.

The aspects defined above and further aspects of the present invention are apparent from the examples of embodiment to be described hereinafter and are explained with reference to the examples of embodiment.

BRIEF DESCRIPTION OF THE DRAWINGS

Embodiments of the invention will now be described, by way of example only, with reference to the accompanying drawings, of which.

The illustration in the drawing is schematically. It is noted that for similar or identical elements in different figures, the same reference signs will be used, as far as not otherwise indicated.

DETAILED DESCRIPTION OF THE INVENTION

Not shown, a gas turbine engine comprises a compressor section, a combustor section and a turbine section which are arranged adjacent to each other. In operation of the gas turbine engine air is compressed by the compressor section and output to the burner section with one or more combustors.

Figure 1:
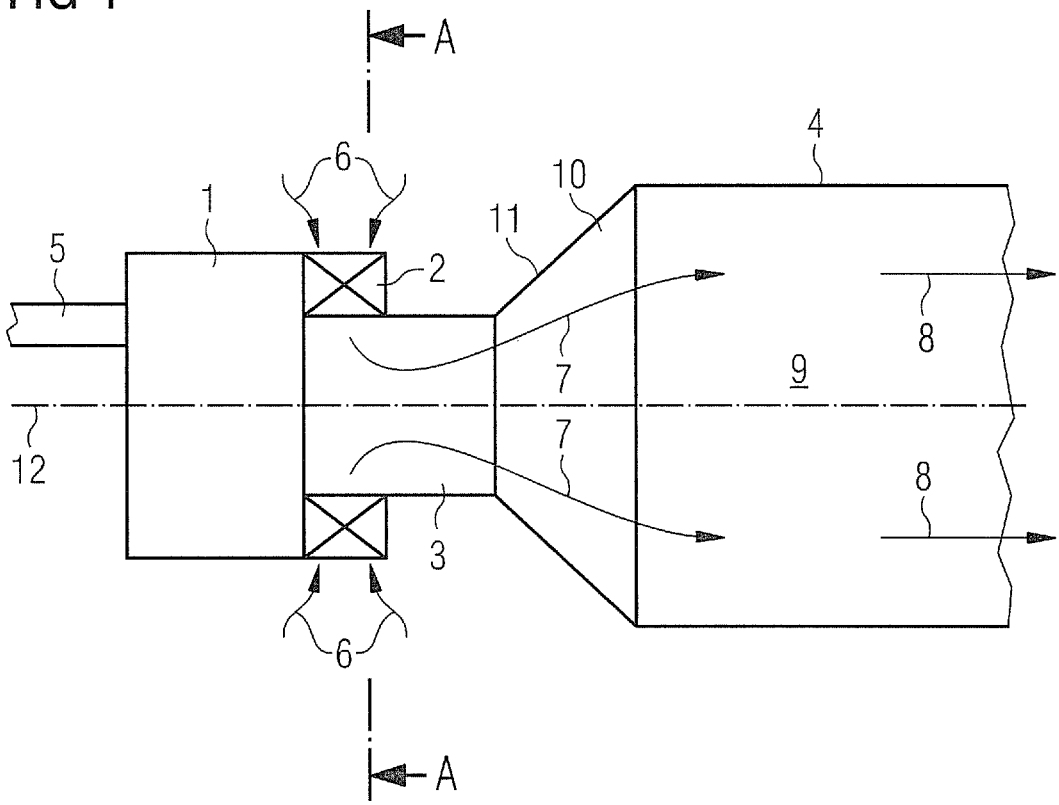
FIG. 1 shows schematically a longitudinal section through a combustor.

FIG. 1 shows a longitudinal section through a combustor, specifically a combustor within a gas turbine engine (not shown). The combustor comprises relative to a flow direction: a burner comprising a burner-head 1 and a radial-type swirler 2 attached to the burner-head 1, a transition piece referred to as combustion pre-chamber 3 and a main combustion chamber 4. The main combustion chamber 4 has a diameter being larger than the diameter of the pre-chamber 3. The main combustion chamber 4 is connected to the pre-chamber 3 via a dome portion 10 comprising a dome plate 11. In general, the transition piece 3 may be implemented as a one part continuation of the burner towards the combustion chamber 4, as a one part continuation of the combustion chamber 4 towards the burner, or as a separate part between the burner and the combustion chamber 4. The burner and the combustion chamber assembly show substantially rotational symmetry about a longitudinally symmetry axis 12.

A fuel supply 5 is provided for leading gaseous and/or liquid fuel to the burner which is to be mixed with inflowing air 6—particularly compressed air from a compressor (not shown)—in the swirler 2. By the swirler 2, the fuel and the air is mixed as will be explained later. The resulting fuel/air mixture 7 is then guided towards the primary combustion zone 9 where it is burnt to form hot, pressurised exhaust gases 8 flowing in a direction indicated by arrows to a turbine section (not shown) of the gas turbine engine (not shown).

Figure 2:
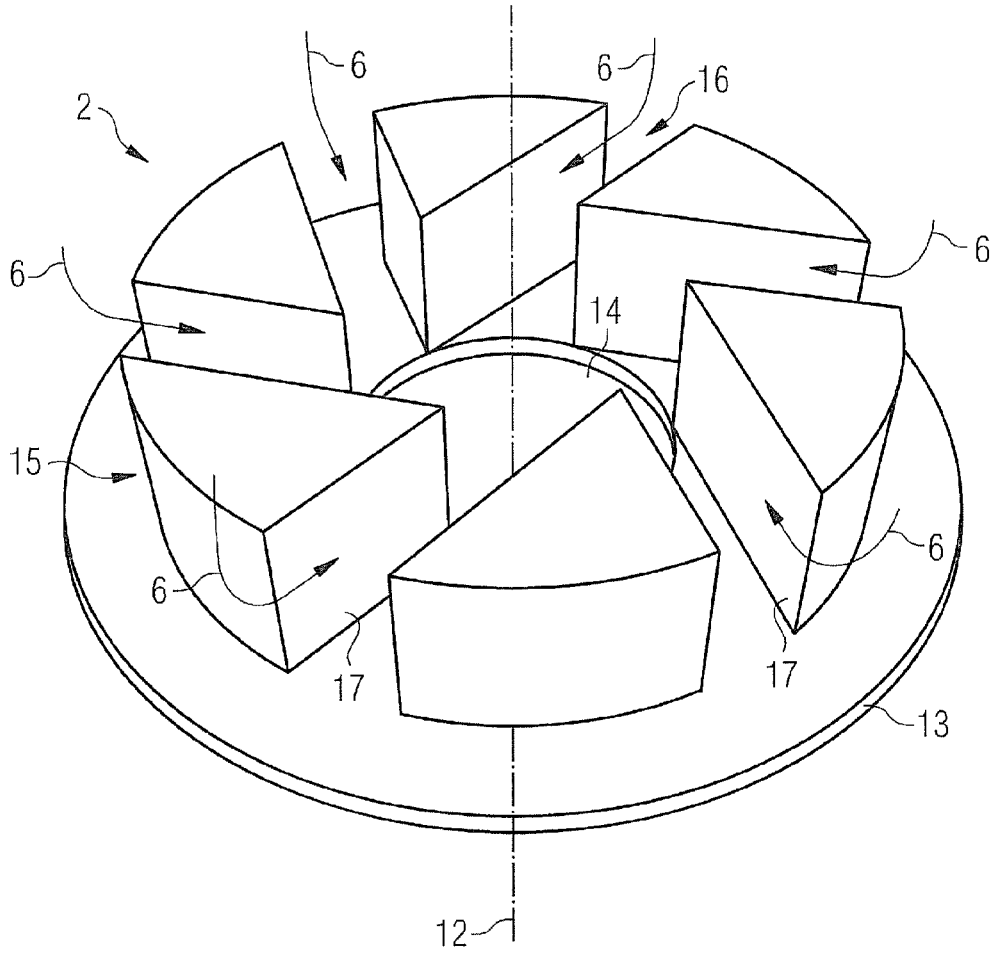
FIG 2 PRIOR ART
FIG. 2 shows schematically a perspective view of a prior art radial type swirler.

A perspective view of a prior art swirler 2 is shown in FIG. 2. The swirler 2, which is a radial swirler, comprises a ring-shaped swirler vane support 13 as a base plate of the swirler 2 with a central opening 14, which leaves a space for the burner face of the burner-head 1 once assembled as the overall burner (burner-head 1 is not shown in FIG. 2). As an example, six swirler vanes 15 each with asymmetric pie slice shape are disposed about the central axis 12 and arranged on the swirler vane support 13. The swirler vanes 15 can be fixed to the burner-head 1 (see FIG. 1) with their body showing away from the swirler vane support 13. Swirler passages 16 as mixing channels are defined and delimited by opposing side faces 17 as walls of swirler vanes 15, by a surface of the swirler vane support 13 and by a surface (not shown) of the burner to which the swirler vanes 15 are fixed. Compressor air 6 flows from radially outside into these swirler passages 16 directed inwards and is mixed with fuel which is added through fuel injection openings (not shown in FIG. 2).

The swirler passages 16 are arranged like that, that the fluid passing the passages 16 are directed to a radial outer section of the central opening 14. Furthermore the swirler passages 16 are substantially directed tangential to the radial outer section of the central opening 14. Besides, in this embodiment of the invention the opposing side faces 17 of a specific one of the swirler passages 16 are substantially planar and parallel to each other.

Figure 3:
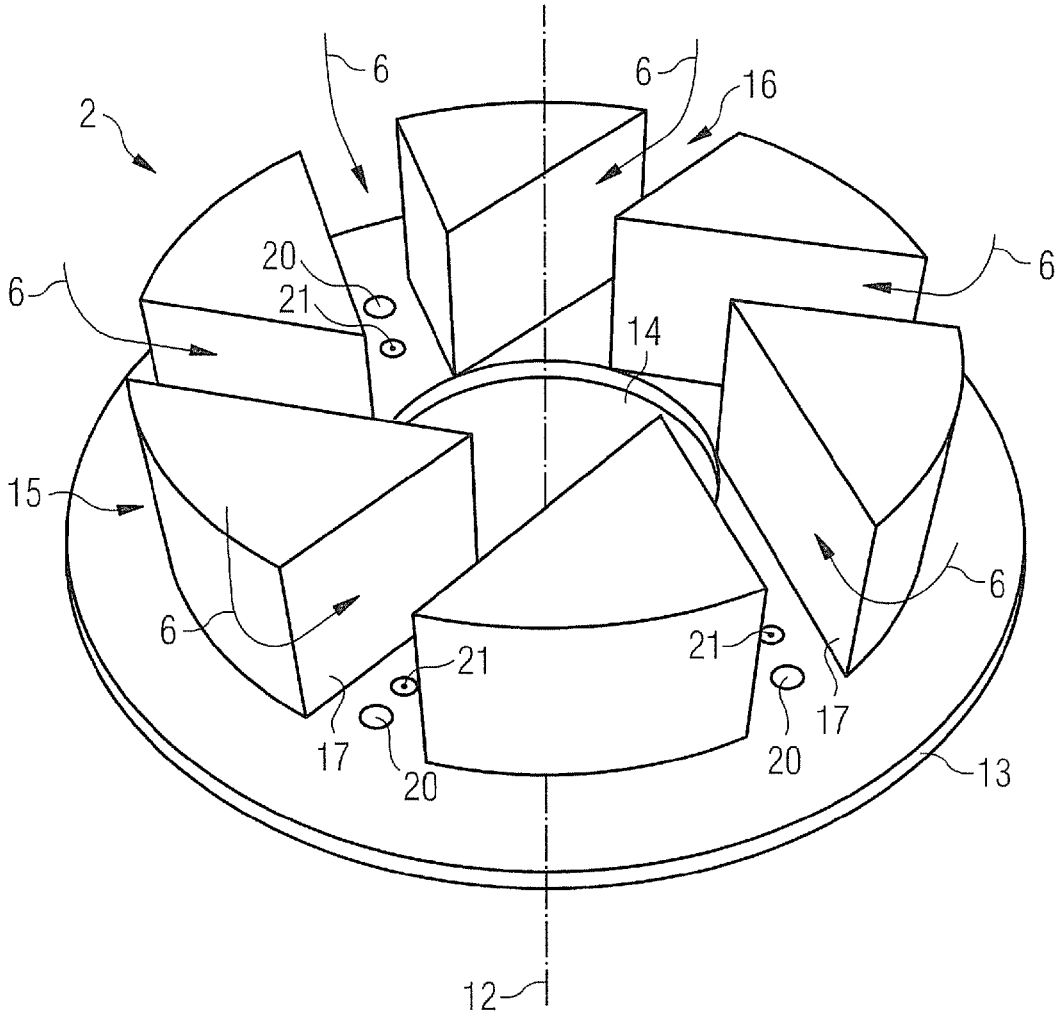
FIG. 3 illustrates schematically a perspective view of a swirler according to the invention.

Referring now to FIG. 3, based on the swirler shown in FIG. 2, the inventive swirler is described. The explanation of the form and the components of the swirler 2 given in respect to FIG. 2 still applies also for FIG. 3 and the further figures.

For each of the swirler passages 16, in FIG. 3 a dimple 20, a fuel injection opening 21—e.g. for liquid fuel or gas fuel—is shown. Several fuel injectors, main and/or supplementary ones, liquid and/or gaseous, may be provided. The shown fuel injection opening 21 should represent a main fuel injector. The fuel injection opening 21 is located in the direction of the radially outward end of a respective one of the swirler passages 16, i.e. at the upstream end of the flowing air 6. The fuel orifice may be plain to a surface of the swirler vane support 13. Alternatively the fuel orifice may protrude the surface of the swirler vane support 13 (not shown).

Further upstream, in FIG. 3 close to the radial outer end of one of the side faces 17, the dimple 20 is located in each swirler passage 16 upstream of the fuel injection opening 21. The dimple 20 is a device that provides a turbulence, particularly a vortex to the air flowing through the swirler passage 16. The fuel is injected into that vortex. Hence, fuel and air mixing is improved, which also may lead to a reduced emission.

In FIG. 3, the dimple 20 has a circular outline and is located on the axis of symmetry of a respective swirler passage 16.

The dimple 20 has a cavity which may be of a specific depth and has no protrusion extending over the surface of the swirler passage 16. In a variation of this embodiment, possibly the outline of the dimple 20 may protrude.

Figure 4A:
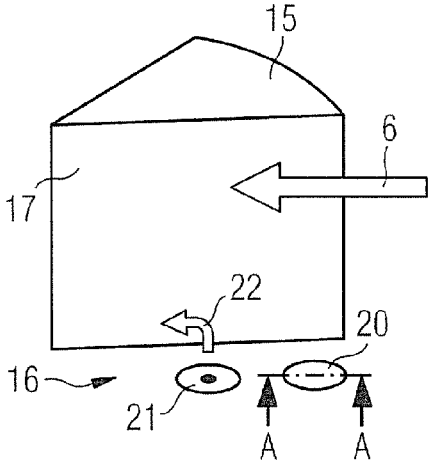
FIG. 4 illustrates a single mixing channel of a swirler with a single dimple.
Figure 4B:
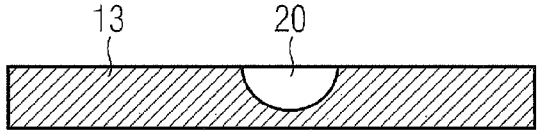

FIG. 4A shows a single swirler passage 16 and a single swirler vane 15 building a part of the swirler passage 16 with its side face 17. The second wall of the swirler passage 16 is not shown. The main air flow 6 is indicated by an arrow. A further arrow shows the injected fuel 22 via the fuel injection opening 21. The dimple 20 is again formed with a circular outline. Its dimensions into the swirler vane support 13 is hemispherical, as indicated in FIG. 4B, which shows a longitudinal section of swirler vane support 13 along the line A-A.

Figure 5:
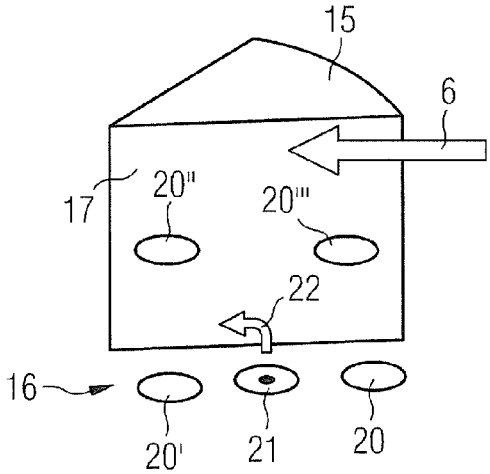
FIG. 5 shows a single mixing channel in an embodiment with a plurality of dimples.

A modification of this embodiment is shown, in FIG. 5. The arrangement corresponds to the one of FIG. 4, but a plurality of dimples is shown. Besides the one dimple 20 in the swirler vane support 13, a further dimple 20' is located in the swirler vane support 13 further downstream of the fuel injection opening 21 which will provide a further turbulence. This is enhanced by additional dimples 20" and 20'" located in the side face 17 of the swirler vane 15. Not shown, on the also not shown opposite wall of the swirler passage 16, there may be the same number of dimples located at symmetric positions.

Figure 6A:
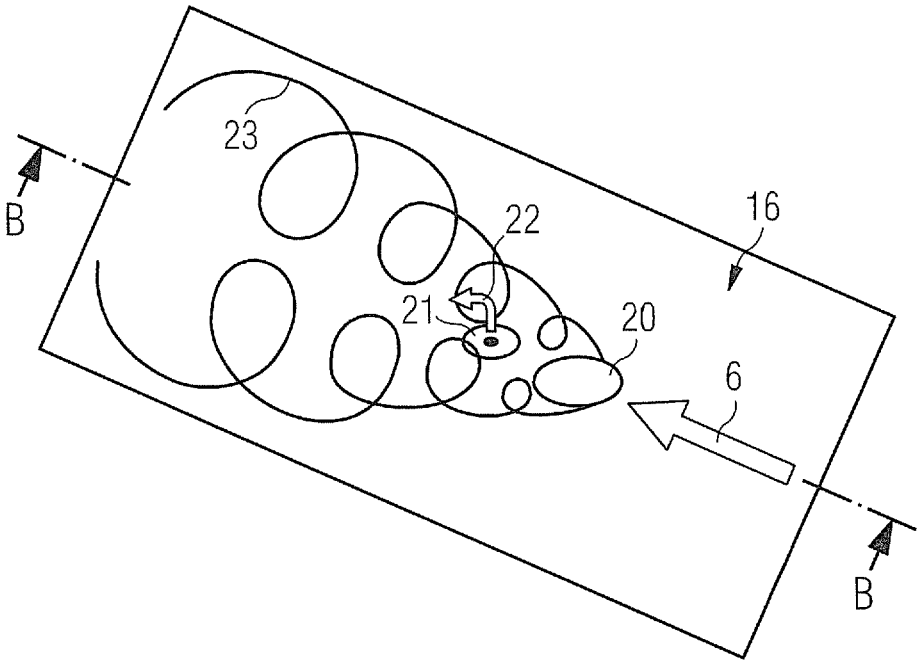
FIG. 6 shows schematically a vortex generated by a dimple.
Figure 6B:
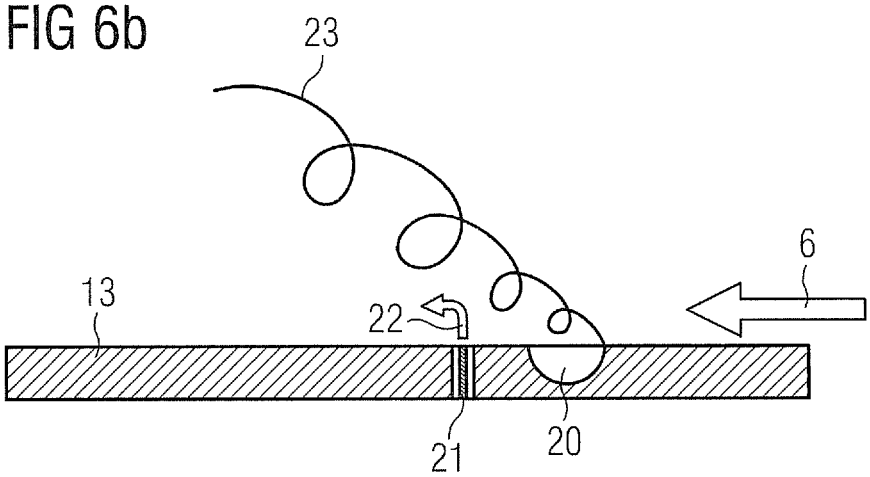

FIG. 6A shows a view from a top view onto the swirler passage 16 from a slight angle. Again, the dimple 20 similar to the one of FIG. 4A, the fuel injection opening 21, the air flow 6 and the injected fuel 22 are shown. FIGS. 6A and 6B additionally visualise schematically a vortex 23 which is generated by the air 6 passing by the dimple 20. The vortex 23 may spread out parallel to the surface of the swirler vane support 13, as it can be seen in FIG. 6A, so that a turbulence is applied until the turbulence is affecting the complete width of the swirler passage 16, but also may extend additionally in a direction leading away from the surface of the swirler vane support 13 until the turbulence is affecting the complete height of the swirler passage 16, as it can be seen in FIG. 6B, which is a sectional view of the swirler passage 16 along the line B-B as indicated in FIG. 6A.

Thus, the vortex 23 will result in roughly a half-conical shape, with the dimple 20 as vortex centre.

Figure 7:
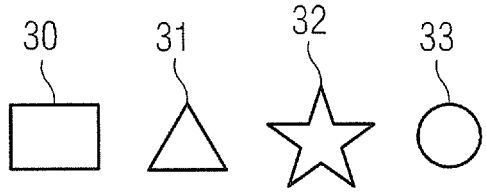
FIG. 7 shows schematically different possible outlines for dimples.

Referring now to FIG. 7, different outlines of the dimple are shown. With outline the form of the dimple is meant as it would show from a top view from top of the surface in which the dimple is present. In FIG. 7 a rectangular dimple 30 is shown, as well as a triangular dimple 31, a dimple 32 in form of a star, e.g. a five-pointed-star with five vertices with acute angles and five cone ends—having the shape of a regular pentagram, also called concave decagon—, and a circular dimple 33. Further shapes are possible and may be advantageous, based on the air flow, the form of the swirler passage 16, the number, location, and orientation of dimples. Especially the outline in form of a star may be of shape of a pentagram but also of different shapes like hexagram, enneagram, heptagram, etc.

Also different forms, like pentagon, hexagon, enneagon, etc. may be possible.

The form of the outline may also define the shape of the recess of the dimple. The recess may be in form of a prism with a flat surface on the ground of the dimple. Alternatively the dimple may smoothly extend into the surface with the deepest point in the centre of the dimple, as it shown in FIG. 4B. Again, all kinds of variations may be possible.

Figure 8A:
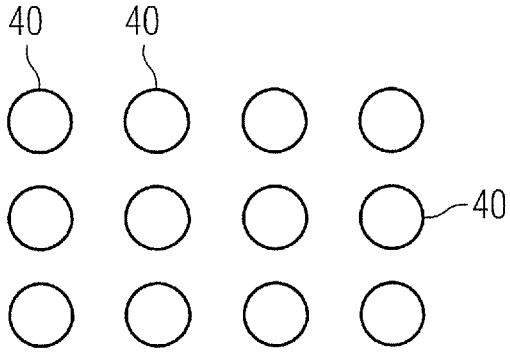
FIG. 8 shows schematically positions of a plurality of dimples on one of the surrounding walls or side faces of the mixing channel of the swirler.
Figure 8B:
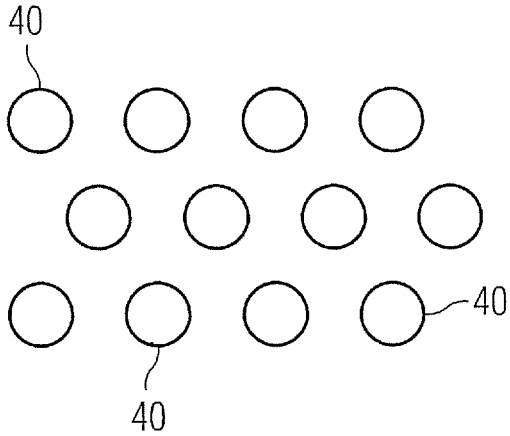

In FIG. 8 two specific arrangements of a plurality of dimples 40 are shown. According to FIG. 8A, the dimples 40 may be arranged equidistant in lines and rows and all dimples 40 in a line or in a row are collinear. FIG. 8B shows alternatively an arrangement of dimples 40 in lines and rows, but the dimples 40 are staggered in a way, that every second line has a specific offset to the previous line. In FIG. 8B the third line of dimples 40 has again the same position as the first line, but this may be seen as a specific embodiment for a more general one, in which every line has an offset, so that line number "n" is identical to line number "1".

Besides, it has to be noted, that all of the above symmetric or asymmetric arrangements of single dimples or of a plurality of dimples may be combined or altered in various ways.

Figure 9A:
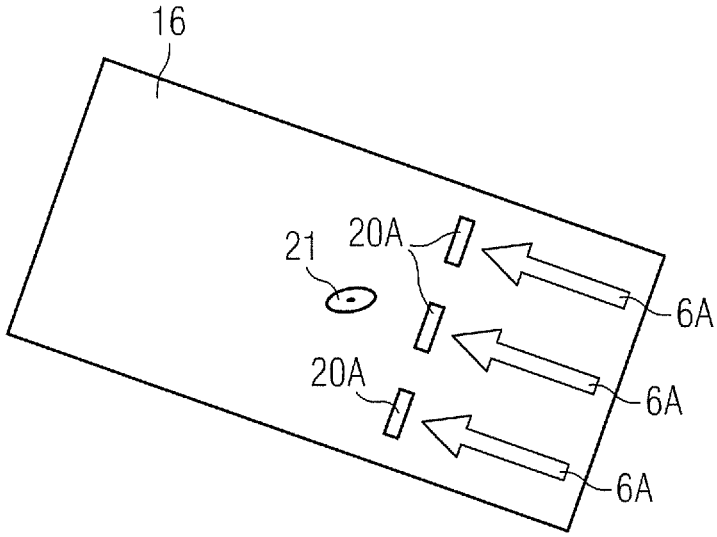
FIG. 9 shows schematically locations and orientations of several dimples in relation to local air velocity.
Figure 9B:
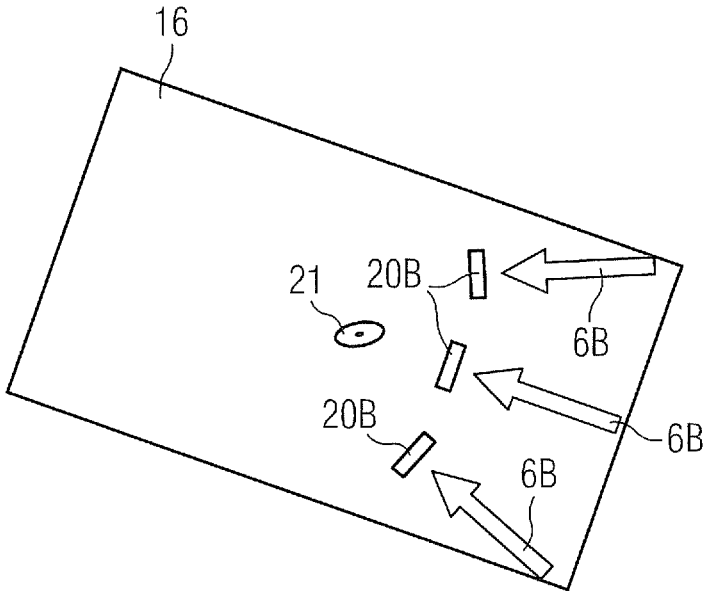

According to FIG. 9, a dimple may be positioned perpendicular to the local flow of air in the swirler passage 16. This will be explained for a dimple with a rectangular outline on the surface which is located in the surface of the swirler vane support 13 within the swirler passage 16. It has to be noted that the shown principle also applies to other outline forms of dimples, to other positions within the swirler passage 16, and to a different number of dimples. In FIGS. 9A and 9B three dimples 20A or 20B are spread over the width of the swirler passage 16, upstream of a fuel injection opening 21. Air entering the swirler passage 16 is indicated by reference signs 6A or 6B.

Referring now to FIG. 9A, it is assumed that the air 6A entering the swirler passage 16 will be laminar and parallel throughout the width of the swirler passage 16. This is indicated by parallel arrows for the air 6A. The dimples 20A will be arranged, so that the longer side of the rectangular will be perpendicular to the air 6A flowing in the area of the respective dimple 20A. Due to the fact that the air 6A is parallel, all dimples 20A will be arranged in the same way, perpendicular to the walls of the vanes (not shown) of the swirler passage 16, so that the longer side of the rectangular is perpendicular to the indicated air flow 6A. According to FIG. 9A the dimples 20A will also be arranged in line, but different arrangements not in line may be also possible.

This may enable a maximum interaction of the dimples 20A with the air flow 6A, generating a stronger vortex. Thus, mixing is promoted of the air 6A and fuel, for fuel injected via fuel injection opening 21 right into the generated vortex.

Especially in locations close to an air inlet of the swirler passage 16, a flow direction of the air may not be parallel. This is indicated in FIG. 9B by arrows for the air, now referenced as the air 6B. According to FIG. 9B the incoming air 6B at an upstream section of the swirler passage 16 flows not parallel. Specifically air in the centre of the swirler passage 16 will continue to flow along a centre line of the swirler passage 16—as before according to FIG. 9A—but air with an offset to the centre line will flow along the centre line but slightly directed to the centre of the swirler passage 16. This is indicated in FIG. 9B with the three arrows for the air 6B, which all are theoretically directed to a fictitious spot on the centre line further downstream of the swirler passage 16.

According to FIG. 9B, the dimples 20B will be positioned on a fictitious circle line, the circle having the mentioned fictitious spot as centre of the circle. The dimples 20B have, as before, a rectangular outline on the surface of the swirler passage 16. The dimples 20B are of such orientation that the longer line of the rectangular is tangential to the circle arc. In other words, the longer line of the rectangular is perpendicular to the local air flow of the air 6B which is present at the spot of the respective dimple 20B.

As before, this may enable a maximum interaction of the dimples 20B with the air flow 6B, leading to a stronger vortex. Thus, mixing of fuel—the fuel being injected via fuel injection opening 21 right into the vortex—and the air 6A is promoted.

Whereas FIG. 9B shows a number of dimples arranged on a curved fictitious base line, additionally the outline of each dimple may be curved itself to follow that base line (not shown). For example, each single dimple then can then be seen as a short arc or a deformed rectangular instead of perfect rectangular.

Not shown in the figures, the burner may be provided with main fuel and pilot fuel. The fuel injection opening 21 according to the figures may be seen as the main fuel injectors. Pilot fuel injectors as supplementary fuel injection openings may optionally be present in all of the embodiments of the invention. The pilot fuel injectors for liquid fuel may be the form of a valve in the centre of the burner-head. A single pilot fuel injector or several ones can be present. A second pilot fuel injector may be present for gaseous fuel, advantageously in form of a ring so that pilot gas can be injected circumferentially at the ends of the swirler passages 16. It has to be noted that also other forms and locations of fuel injections may be possible. And as in all embodiments of the invention, a burner may be limited to only liquid fuel or only to gaseous fuel. Alternatively the burner may be equipped with both liquid and gaseous fuel injectors.

Advantageously, the pilot fuel injectors are located downstream of the swirler passage 16. During operation of the gas turbine, the fuel—either gas or liquid—is introduced in two stages: with a main injection via the fuel injection opening 21, which results in a high degree of premixedness and hence low $NO_X$ emissions, and a pilot injection via the pilot fuel injectors. The pilot injection may steadily be increased as the load demand decreases in order to ensure flame stability, which may not be guaranteed with lower loads. The pilot fuel injectors are arranged, such that as the pilot fuel split increases, the fuel is biased towards the axis—axis 12 as indicated in FIG. 1—of the combustor. This avoids problems with combustion instability at lower loads.

In operation mode with lean premix combustion, which may be selected to reduce $NO_X$, pilot fuel injection may even be advantageous to stabilize the flame even at higher or full load, however, the percentage of fuel injected via the pilot fuel injectors compared to the overall fuel injection may be small for full load, for example 5%.

With the pilot fuel injection severe combustion dynamics may be avoided, which otherwise could take place due to combustion at near limit of flammability.

All in all, the invention and all embodiments allow to generate an improved air/fuel mixture, which leads to a more stabilised flame, also in a lean operation, and consequently also to less $NO_X$ emissions.

The invention claimed is:

1. A swirler for mixing fuel and air in a combustion chamber of a gas turbine engine, comprising:

a plurality of vanes positioned radially around a central axis of the swirler; and a plurality of mixing channels for mixing the fuel and the air, at least one mixing channel of the plurality of mixing channels being defined by opposite walls of two adjacent vanes of the plurality of vanes and comprising at least one fuel injection opening and comprising at least one dimple for generating a vortex of the air, wherein said at least one dimple is arranged in the at least one mixing channel upstream of the fuel injection opening in reference to a flow direction of the air, wherein said at least one dimple is arranged in the at least one mixing channel in a base plate of the swirler.

2. The swirler according to claim 1, wherein a further dimple is arranged in the at least one mixing channel downstream of the fuel injection opening in reference to the flow direction of the air.

3. The swirler according to claim 1, wherein a further dimple is arranged in the at least one mixing channel between the fuel injection opening and one of the opposite walls, the further dimple having an elongated shape that is perpendicular to the flow direction of the air.

4. The swirler according to claim 1, wherein a further dimple is arranged in the at least one mixing channel in one of the opposite walls.

5. The swirler according to claim 1, wherein the at least one dimple is formed substantially hemispherically.

6. The swirler according to claim 1, wherein the at least one dimple has an outline in form of an ellipse or a polygon.

7. The swirler according to claim 1, wherein the at least one dimple has an outline in form of a circle.

8. The swirler according to claim 1, wherein the at least one dimple has an outline in form of a triangle.

9. The swirler according to claim 1, wherein the at least one dimple has an outline in form of a star.

10. The swirler according to claim 1, wherein the at least one dimple has an outline in form of a rectangle.

11. The swirler according to claim 1, wherein a plurality of the at least one dimple are arranged in at least one row and at least one column in an inline or staggered pattern.

12. The swirler according to claim 1, wherein the at least one dimple and the fuel injection opening are arranged such that the fuel injected via the fuel injection opening is injected into the vortex.

13. The swirler according to claim 1, wherein a first one of the at least one fuel injection opening is arranged to inject liquid fuel, and/or a second one of the at least one fuel injection opening is arranged to inject gaseous fuel.

14. The swirler according to claim 1, wherein the swirler comprises a plurality of supplementary fuel injection openings.

15. The swirler according to claim 1, wherein said at least one dimple is elongated perpendicular with respect to a local flow direction of a component of the air flow which travels towards a spot of said at least one dimple.

16. A combustion chamber in a turbine engine, comprising:

a swirler for mixing fuel and air, comprising:

a plurality of vanes positioned radially around a central axis of the swirler; and a plurality of mixing channels for mixing the fuel and the air, at least one mixing channel of the plurality of mixing channels being defined by opposite walls of two adjacent vanes of the plurality of vanes and comprising at least one fuel injection opening and comprising at least one dimple for generating a vortex of the air, wherein said at least one dimple is arranged in the at least one mixing channel upstream of the fuel injection opening in reference to a flow direction of the air, wherein said at least one dimple is arranged in the at least one mixing channel in a base plate of the swirler, wherein a further dimple is arranged in the at least one mixing channel downstream of the fuel injection opening in reference to the flow direction of the air.

17. The combustion chamber of claim 16, wherein said at least one dimple is elongated perpendicular with respect to a local flow direction of a component of the air flow which travels towards a spot of said at least one dimple.

18. A gas turbine; comprising:

at least one combustion chamber for combustion of a fuel/air mixture, the combustion chamber comprising:

a swirler for mixing the fuel and the air, the swirler comprising:

a plurality of vanes positioned radially around a central axis of the swirler; and a plurality of mixing channels for mixing the fuel and the air, at least one mixing channel of the plurality of mixing channels being defined by opposite walls of two adjacent vanes of the plurality of vanes and comprising at least one fuel injection opening and comprising at least one dimple for generating a vortex of the air, wherein said at least one dimple is arranged in the at least one mixing channel upstream of the fuel injection opening in reference to a flow direction of the air, wherein said at least one dimple is arranged in the at least one mixing channel in a base plate of the swirler, wherein a further dimple is arranged in the at least one mixing channel downstream of the fuel injection opening in reference to the flow direction of the air.

19. The gas turbine of claim 18, wherein said at least one dimple is elongated perpendicular with respect to a local flow direction of a component of the air flow which travels towards a spot of said at least one dimple.

* * * * *